US005440072A

United States Patent [19]

Willis

[11] Patent Number: 5,440,072

[45] Date of Patent: Aug. 8, 1995

[54] SYSTEM FOR REJUVENATING VINTAGE ORGANS AND PIANOS

[76] Inventor: Raymon A. Willis, 419 E. 33rd St., Savannah, Ga. 31401

[21] Appl. No.: 950,518

[22] Filed: Sep. 25, 1992

[51] Int. Cl.[6] ..... G10H 7/00

[52] U.S. Cl. ..... 84/645; 84/170

[58] Field of Search ..... 84/170, 171, 174, 331, 84/645

[56] References Cited

U.S. PATENT DOCUMENTS

| | | | |
|---|---|---|---|
| 3,604,299 | 9/1971 | Englund . | |
| 3,647,929 | 3/1972 | Milde, Jr. . | |
| 3,652,776 | 3/1972 | Milde, Jr. . | |
| 3,771,406 | 11/1973 | Wheelwright . | |
| 3,789,719 | 2/1974 | Maillet . | |
| 3,868,882 | 3/1975 | Fukui et al. . | |
| 3,871,247 | 3/1975 | Bonham . | |
| 3,886,543 | 3/1975 | Marin . | |
| 3,895,554 | 7/1975 | Maillet . | |
| 3,905,267 | 9/1975 | Vincent . | |
| 3,926,088 | 12/1975 | Davis et al. . | |
| 3,951,028 | 4/1976 | Robinson . | |
| 3,955,460 | 5/1976 | Southard . | |
| 4,012,982 | 3/1977 | Southard . | |
| 4,022,098 | 5/1977 | Deutsch et al. . | |
| 4,023,456 | 5/1977 | Groeschel . | |
| 4,033,221 | 7/1977 | Tomisawa et al. . | |
| 4,046,047 | 9/1977 | Roberts . | |
| 4,351,221 | 9/1982 | Starnes et al. . | |
| 4,686,880 | 8/1987 | Salani et al. . | |
| 4,704,931 | 11/1987 | Nagai et al. | 84/171 X |
| 4,768,412 | 9/1988 | Sanderson | 84/453 X |
| 4,939,969 | 7/1990 | Taguchi et al. | 84/171 X |
| 5,001,339 | 3/1991 | Starkey et al. . | |
| 5,237,125 | 8/1993 | Fields | 84/645 X |

OTHER PUBLICATIONS

"Midi Goes Maintstream", PC Magazine, Mar. 31, 1992.

*Primary Examiner*—William M. Shoop, Jr.
*Assistant Examiner*—Jeffrey W. Donels
*Attorney, Agent, or Firm*—Jim Zegeer

[57] ABSTRACT

A system for rejuvenating conventional old or vintage keyboard musical instruments to MIDI standards, includes, one or more linear arrays of key actuation sensors, printed circuit boards carrying the key actuation sensors which sense key actuation and expression effects by a musician, a rigid channel or bar mounting carries the one or more linear arrays under or over the keyboard of the musical instrument to convert each key actuation and expression effect of the musician to first coded electrical signals, respectively. A MIDI controller is connected to receive the first coded digital electrical signals and provide digital note control signals in MIDI format, and one or more performance modules connected to receive the digital note control signals supplying signals to a power amplifier and speaker system to produce a musical performance.

8 Claims, 9 Drawing Sheets

SYSTEM FOR REJUVENATING VINTAGE ORGANS AND PIANOS

BACKGROUND AND BRIEF DESCRIPTION OF THE INVENTION

Numerous old pianos and organs are located in schools, churches, and entertainment complexes (community recreation centers, night clubs, etc.). To replace them with modern electronic musical equipment which has been provided with the flexibility of an musical instrument digital interface (MIDI) would be very expensive. Many churches, communities and school systems cannot afford expensive new electronic musical equipment and their current older equipments, while adequate for limited musical services, are not able to support visiting musical groups, for example, who must therefore bring their own musical instrumental accompaniments to maintain the "sound" achieved by that group in their home area. For example, a choral group given to accompaniment by a particular organ "sound" does not sound the same when accompanied by an older organ or piano.

The object of this invention is to provide a method and apparatus for upgrading old organs and pianos at relatively low cost and provide such older organs and pianos with sensors for sensing key and pedal actuation and means to mute or prevent sound from being generated by the instrument. The sensed key and pedal activation is converted to electrical signals, digitized and formatted by conventional electronic circuitry. These signals are applied to a MIDI controller which, in turn, can control various electronic musical modules (piano, organ, guitar, violin, etc.) for a visiting choral group, for example.

According to the invention, linear arrays of conventional key actuation and expression effect sensors on a printed circuit board are mounted on a rigid bar to prevent deflection thereof and then positioned over or under, and aligned with, the keys of a vintage organ or piano being rejuvenated to thereby individually sense key actuation and expression effects. The bar includes adjustment means for vertical and horizontal adjustments relative to the keys. Separate sensors are coupled to the pedals ("soft", "sustain", "sustenuto") of a piano, for example.

In the case of a piano, a muting pad and bar is positioned between the ranks of note hammers and mutes the piano. In the case of an pipe organ, the air pump or supply is shut off, and in the case of an electronic organ, the power amplifier can be turned off by a disable signal.

A further object of this invention is to eliminate having three or four keyboards when the musician can bring his or her module, drum machine or sequencer, etc. and MIDI it into a vintage organ or vintage piano.

A further advantage of the invention, is that you can have that rich "Hammond" organ sound; in addition the musician would have access to thousands of sounds such as piano, strings, bass, brass, percussion sounds, etc. The musician can also use any MIDI device such as a sequencer, computer, etc. The musician would be able to write songs, record them, play them, back all from one organ or piano, and can also prepare musical sound tracks, so when he or she go to the studio all they would have to do is the vocals; this will cut studio time by at least 50%.

DESCRIPTION OF THE DRAWINGS

The above and other objects, advantages and features of the invention will become more apparent when considered with the following specification and accompanying drawings wherein.

DETAILED DESCRIPTION OF THE INVENTION

Figure 1A:
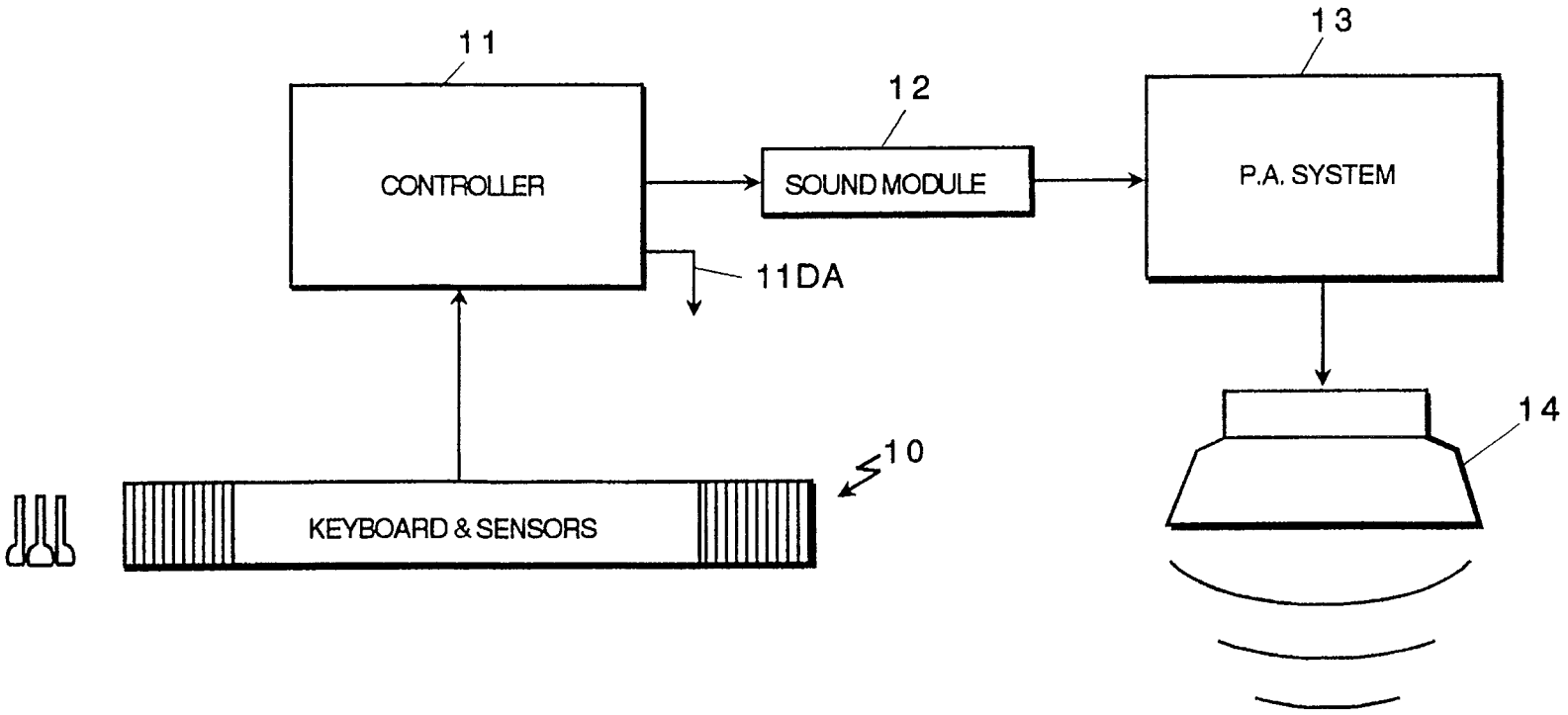
FIG. 1A is a general block diagram of the electronic system incorporated in this invention.

Referring to FIG. 1A, a keyboard 10, which is on an older vintage piano or organ has been fitted with sensor strips, as described later herein, so that operation of the keys on the keyboard by the musician is scanned or strobed to detect keyboard actuations and produce electrical signals corresponding to the key actuation, force or intensity and duration. These signals are supplied to a conventional MIDI controller or interface 11. MIDI interface 11 includes conventional microprocessor circuitry which enables controller 11 to command sound module 12, which may also include a microprocessor for receiving and interpreting control signals from the microprocessor in MIDI controller 11. MIDI is the digital operating standard for electronic music and many texts and articles provide extensive details thereof. Reference is made to the text "Synthesizers And Computers" edited by Brent Hurtig, copyright 1985, 1987, which is incorporated herein by reference. There may be many different forms or styles of modules 11, each of which produces a different "sound" on control from controller 11 which, in turn, receives data input from the sensor strips which have been installed under keyboard 10 of the older musical instrument.

For example, sound module 12 can be a 16 bit stereo piano module which provides the rich time stereo sound of a concert grand piano such as Proformance TM Model 9101 or Proformance TM Model 9102 from E-Mu Systems, Inc. In these modules, exceptionally realistic sounds of a real grand piano are permanently recorded in digital memory chips and processed in very large scale integrated circuits (VLSI) technology. The output has a wide dynamic range and frequency response which results in the rich sound of a very expensive concert grand.

If the instrument has foot operated pedals 10P, they will also be equipped with sensor strips according to the invention.

Module 12 provides analog output signals of the various notes selected to be played by keyboard 10 to power amplifier system 13 and thence to loud speakers 14. The MIDI controller 11, module system 12, power amplifier 13 and loud speakers 14 are conventional and hence need not be described in greater detail herein. When activated, controller 11 optionally, may provide a disable signal 11DA which is used to disable the regular electronic organ components and thus mute same, or activate a bar between the hammers of a piano and the string struck thereby.

Figure 6:
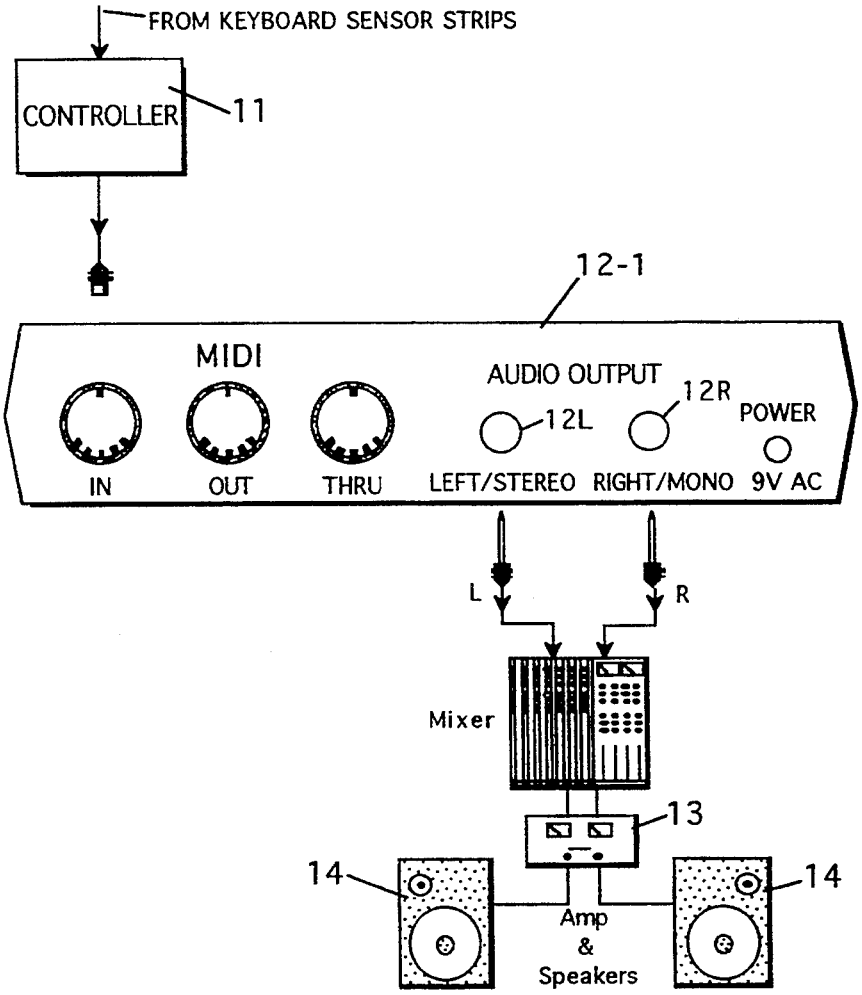
FIG. 6 is a diagrammatic illustration of a portion of the rear panel of one commercial sound module used in the invention.

FIG. 6 (prior art) is a diagrammatic illustration of a portion of the rear panel of The Proformance TM sound module 10-1 with MIDI "in", "out" and "through" connectors, the output of MIDI controller 11 being connected to the "in" connector, and the audio output jacks 12L and 12R being coupled to a mixer 9 and then a amplifier 13 to speakers 14.

Figure 1B:
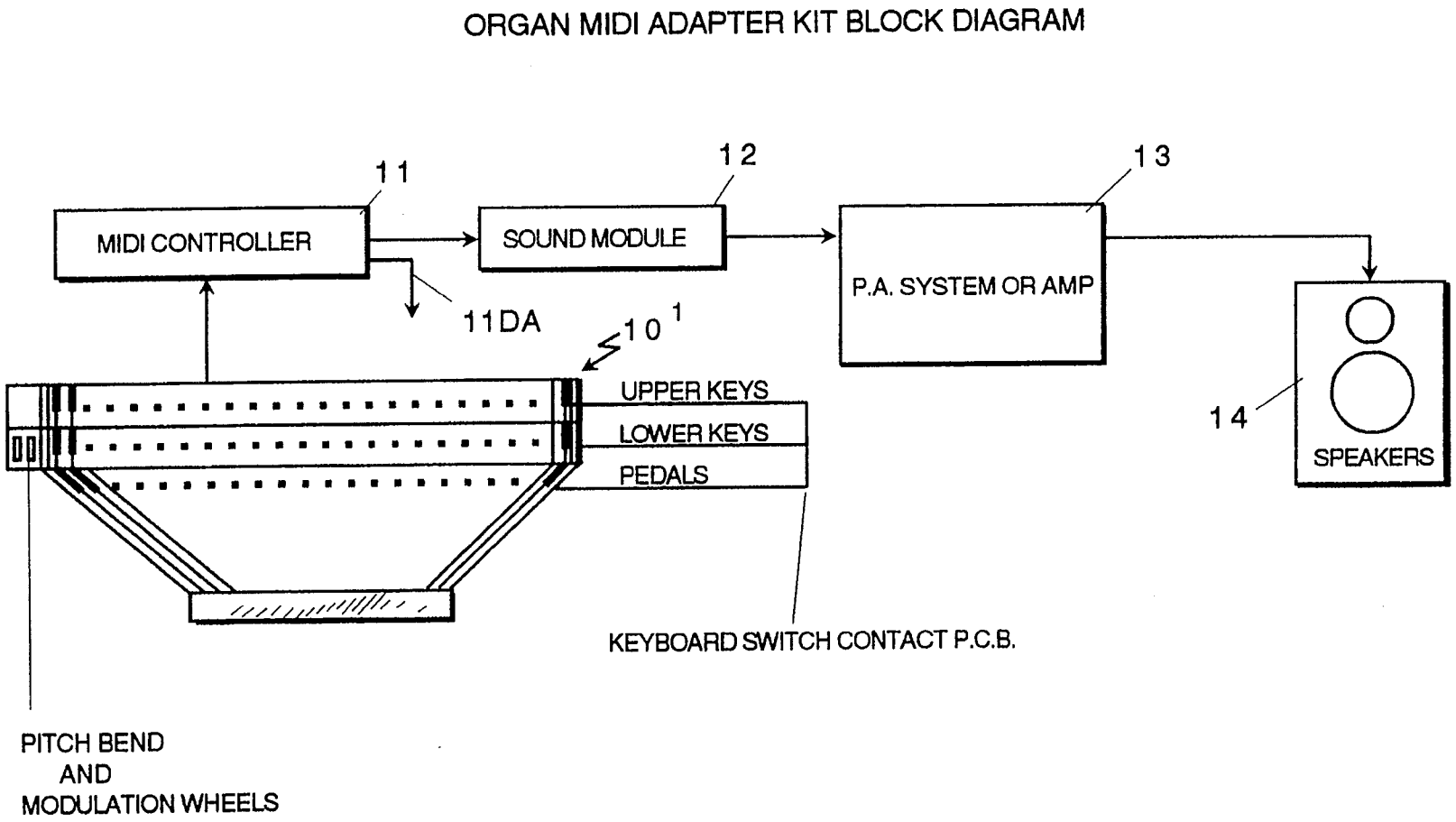
FIG. 1B is a block diagram of the invention as applied to an organ.

FIG. 1B illustrates the invention as applied to an electronic organ EO wherein the keyboard 10' is constituted by upper keyboard 15U, lower keys 15L, which may include pitch bend and modulation wheels 17 and. 18. The foot pedals 19 may include a keyboard switch contact on a printed circuit board similar to that to be described later herein, sensing actuations of the foot pedals.

Figure 1C:
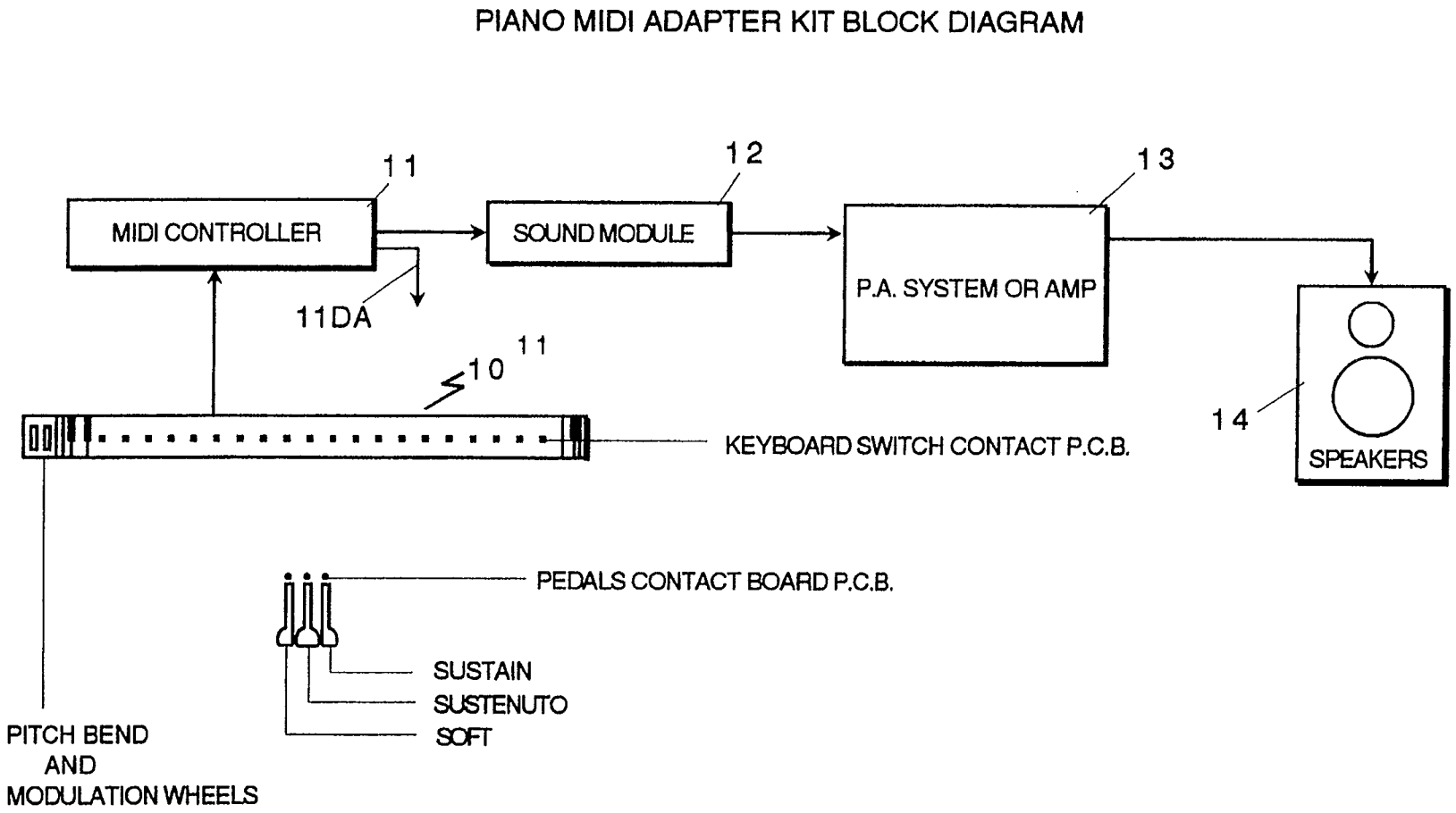
FIG. 1C is a block diagram of the invention as applied to a piano.
Figure 2A:
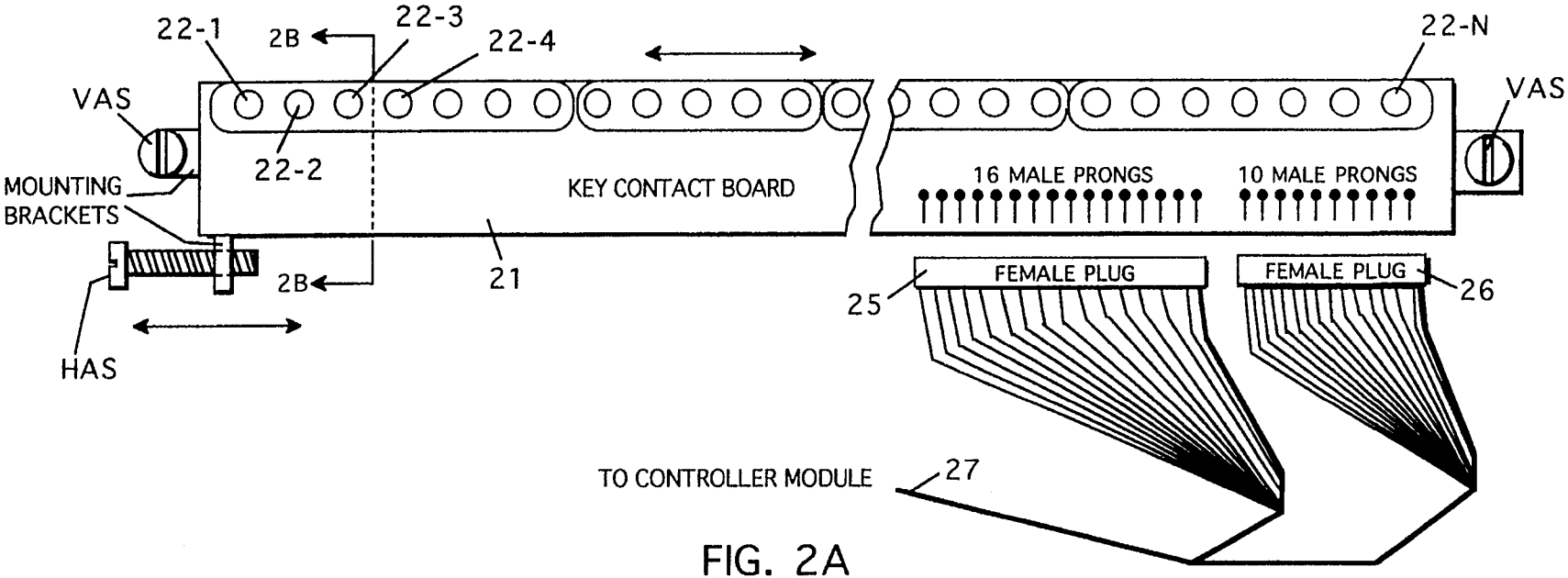
FIG. 2A is a top plan view of the a actuation sensor strip device of the present invention.
Figure 2D:
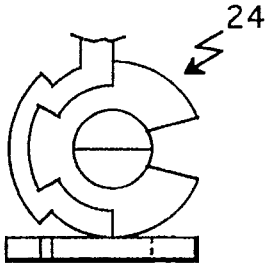
FIG. 2D (PRIOR ART)
FIG. 2B is a sectional view on lines A—A of FIG. 2A, FIGS. 2C and 2D are sectional views of one key sensor incorporated in the invention.
Figure 2C:
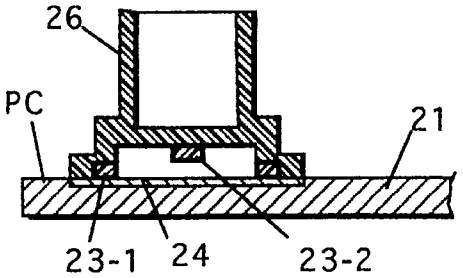
FIG. 2C (PRIOR ART)
Figure 2B:
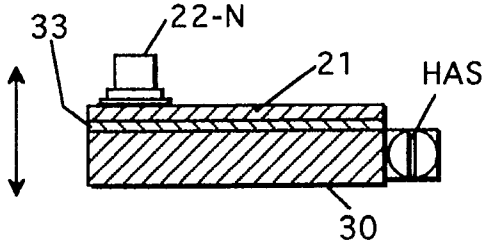
Figure 3:
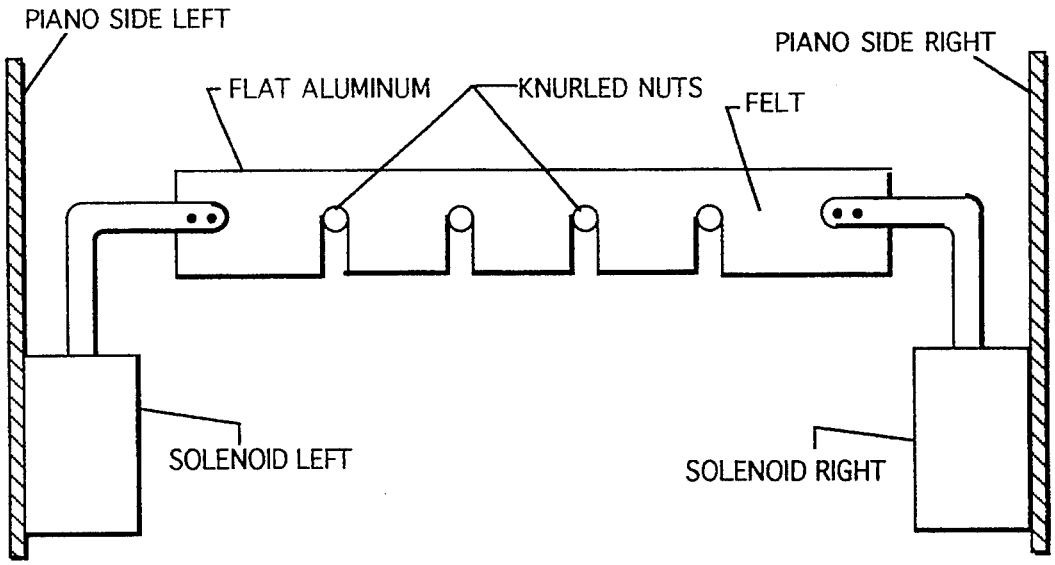
FIG. 3 is an end view of a MIDI adaptor kit piano silencer according to the invention.

In like manner, FIG. 1C is a block diagram of the invention as applied to a piano and, in this case, the keyboard 10" is provided with key contact circuit boards.

Figure 4A:
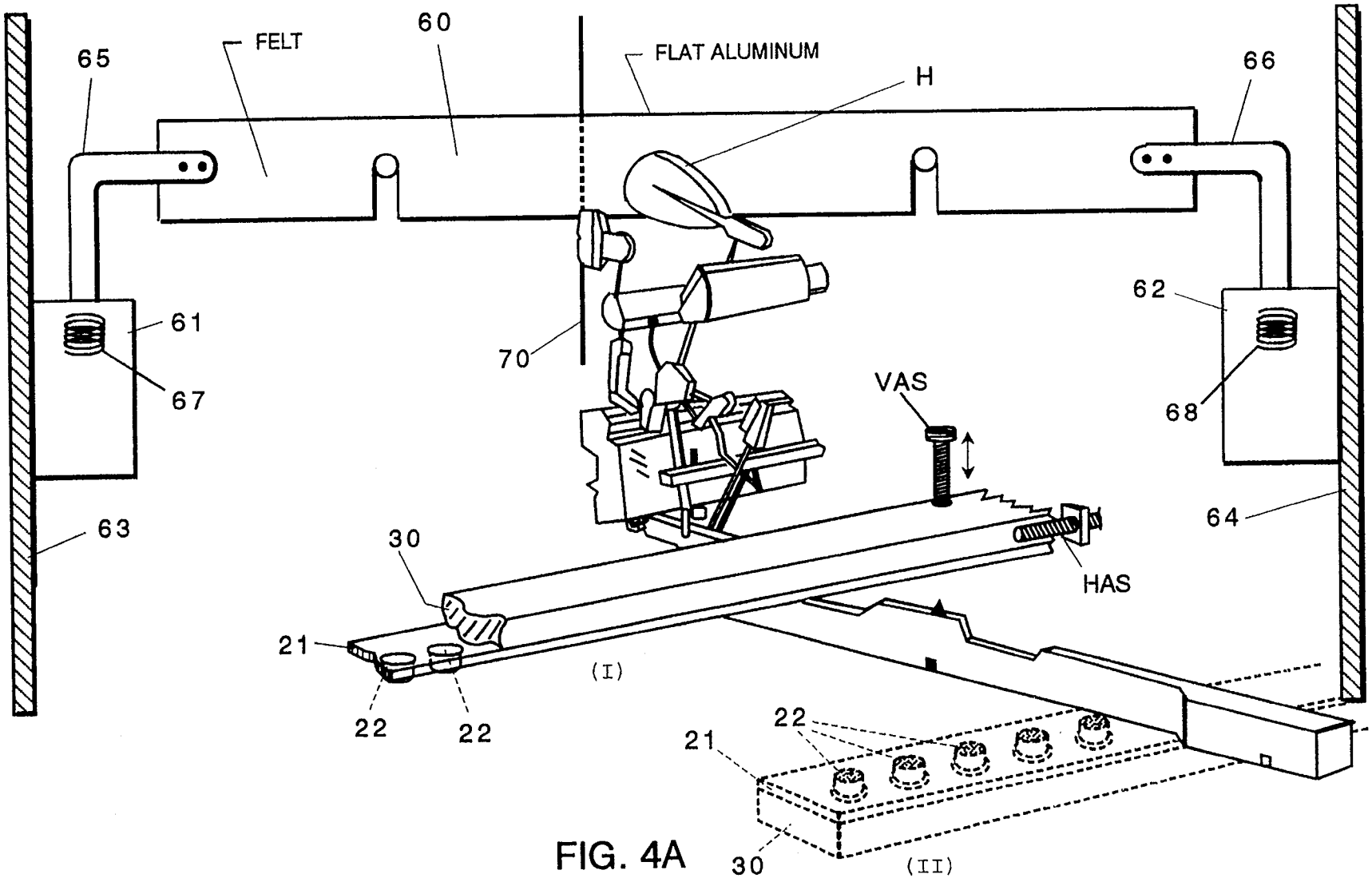
FIG. 4A is an end isometric view of acoustic piano key showing a key actuation mechanism and key actuation sensor in a preferred position and the piano silencing mechanism in operative position.
Figure 5A:
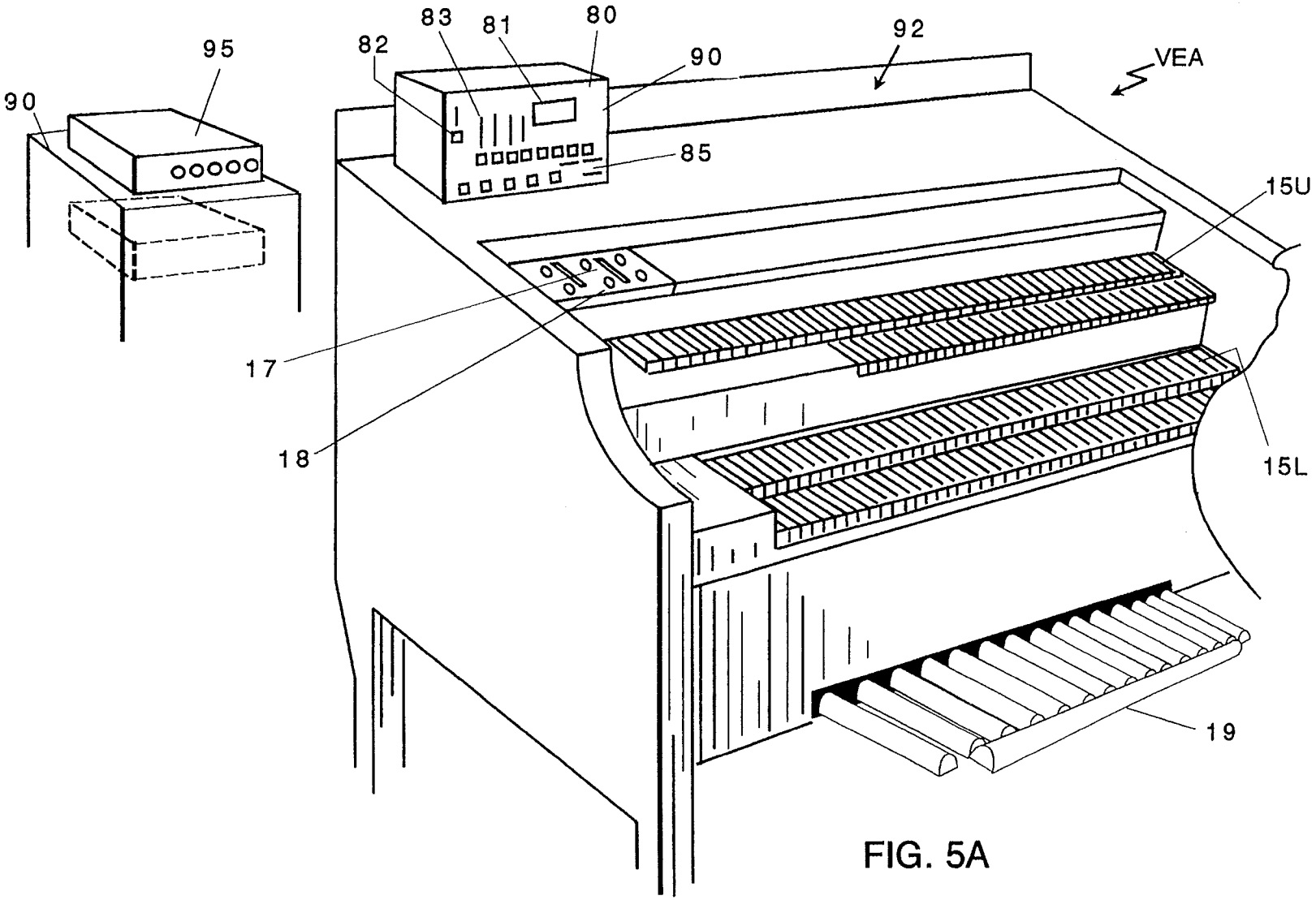
FIG. 5A is an isometric view of a vintage electric organ which has been modified according to the invention.
Figure 5B:
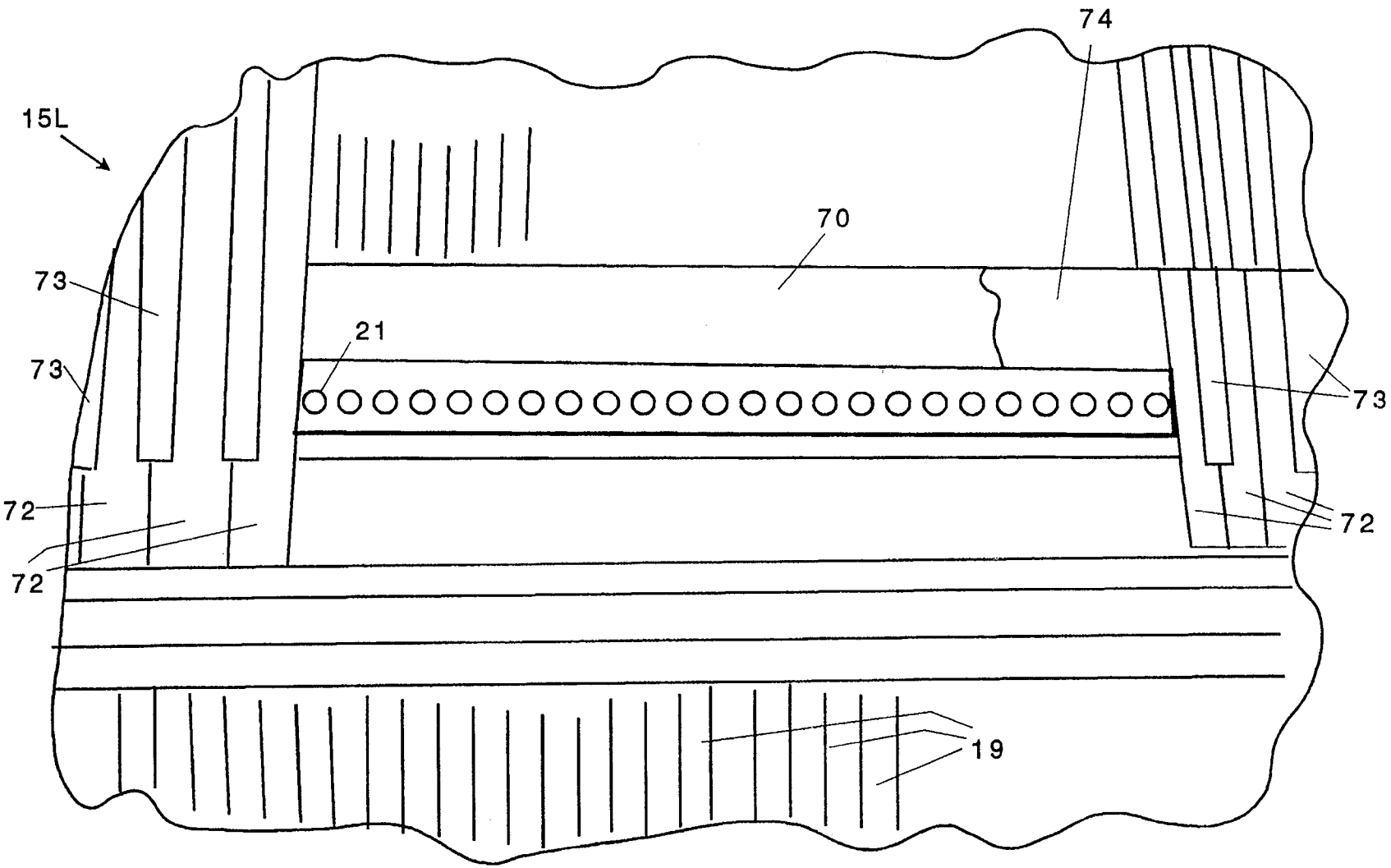
FIG. 5B is a top plan view of a portion of the keyboard with a bank of 26 white and black keys in the upper keyboard removed showing a key actuation sensor strip of the type shown in FIGS. 2A and 2B and installed under the keys.

Referring to FIGS. 2A, 2B, 2C and 2D the key contact board which is fitted over or under the keyboards in the organ shown in FIG. 5B or the piano shown in FIG. 4A includes a printed circuit board 21 carrying conventional rubber-like flexible key contact members 22-1, 22-2, 22-3 . . . 22-N which have electrical contacts 23-1, 23-2 on the internal surfaces thereof for contacting circuit portions 24 (FIG. 2D) of the printed circuit board 21. Conventional diode-resistor circuits on printed circuit board 21 produce electrical signals at the output terminals 25, 26 which are scanned or strobed by the MIDI interface control circuit 11 to detect the actuation of the key, the intensity with which the key is contacted, and the length of time that it is held down by the musician. In one commercially available printed circuit board of this kind, there are coupling elements 25 and 26 which form cabling 27 to the MIDI interface controller 11.

As shown in the sectional view, the printed circuit board 21 is provided with a sensor carrier and rigidifying member which, in the preferred embodiment, is an aluminum bar or channel member 30 upon which the printed circuit board 21 is insulatingly mounted by screws 32. Spacer member 33 is an insulated strip which precludes the rigidifying aluminum bar or channel 30 from short-circuiting any of the printed circuit wiring on the underside of printed circuit board 20. The lateral ends of the bar are provided with horizontal HAS and vertical adjusting screws AS so as to permit the alignment and leveling of the key contact buttons 22-1, 22-2, 22-3 . . . 22-N relative to the top sides or undersides of each of the respective piano keys. The sensor carrier and rigidifying bar 30, beam or channel member 30 prevents deflection of the key actuation sensor strip and maintains them in accurate alignment with the keys of the vintage instrument being rejuvenated.

Thus, as each key is struck by the musician in conventional fashion, the key actuation sensors detect the key switch which has been activated by the musician, the intensity with which it has been struck and the time duration it has been held down, and this data is digitized by conventional A/D converters in MIDI interface controller 11.

Referring to FIG. 4A, installation of the key contact printed circuit board and rigidifying bar is illustrated as being installed in two possible positions in a piano: I) where the contact board is upside down relative to the piano keys and along the top thereof beyond the key pivot, and II the other is directly below the keys. Either place is acceptable under the invention but it is preferred to use the upside down position in position U, particularly in connection with a number of older piano and organ keyboards. In the upside down position, less disassembly of the piano or organ is required. In some cases, a combination of the two mounting positions could be used. It will be appreciated that in a number of piano operating mechanisms (see the example of FIGS. 4A and 4B). The key actuation sensor strips can be located in positions to sense movement of a component other than a key.

In connection with application of the invention to a piano, it will be noted that in FIGS. 4A nd 4B, a felt covered aluminum muting or silencing bar 60 is controlled by one or more solenoids 61, 62, which may be mounted on the piano left and right sidewalls 63, 64, respectively, and have operating arms 65, 66, respectively, which are secured to muting bar 60. Muting bar 60 is preferably comprised of a light-weight aluminum bar which is coated with a felt, foam or other sound absorbing medium. The muting bar 60 could be made of wood, plastic, fiberglass or other rigid materials capable of silently absorbing the impact of the felted note hammer.

Solenoids 61 and 62 are energized by the disable signal 11DA when the power is supplied to the MIDI interface controller 11, for example. Alternatively, a separate independent control switch 68 may be used to couple the solenoids 61 and 62 to a source of operating power. Operating arms 65 and 66 are spring loaded in this embodiment so that on energization of the solenoid 61 and 62, the springs 67, 68 are compressed and loaded so that upon deenergization of the solenoids 61 and 62, the springs 68, 69 urge the arm 65, 66 upwardly so as to reposition the muting or silencing bar 60 in an inoperative position so that the acoustic piano can be played in the normal manner by a musician.

The purpose of the muting or silencing bar 60 is to assure that when the piano keys are played, the hammer and its conventional operating mechanism are not mechanically affected or disabled but that no notes are played or sound made. As shown, in FIG. 4A, when felted hammer H is actuated, it may strike the flat muting or silencing bar 60 but no sound is made by the associated piano string 70 because of the interposition between the hammer H and string 70 of the muting or silencing bar 60. On the other hand, the associated key sensor 21-N is actuated and an electrical signal is generated corresponding to the key actuated, the intensity and duration or expression effects on the keyboard and this signal is then supplied via the cabling (FIG. 2A) to the MIDI interface controller circuit 11 which, in turn, controls the sound module 12 to cause a particular note or sound selected by the musician to be played. Thus, although the keyboard has the same mechanical "feel" as before, no notes are played by the acoustic piano itself. Instead, the musician is in effect using the keyboard in a MIDI system constituted by MIDI controller 11, sound module 12, power amplifier system 13 and the loud speaker 14.

Figure 4B:
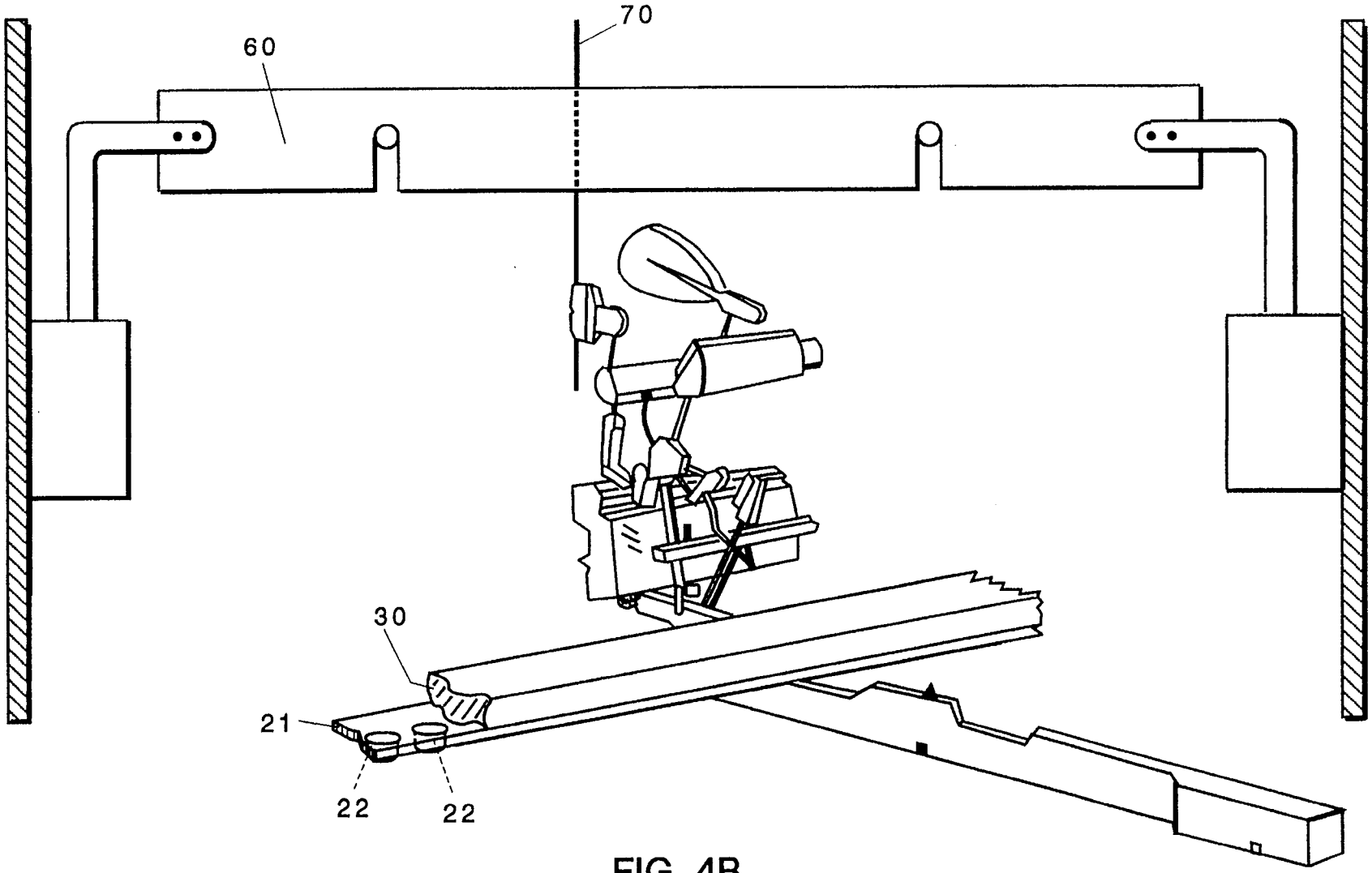
FIG. 4B is an end isometric view similar to FIG. 4A showing the silencing mechanism in inoperative position so the piano can be played in normal fashion (in this case the sensoring is, in effect, optionally disabled)

In FIG. 4B, the silencing or muting bar 60 is shown in an elevated position so that the fitted hammer H and hammer actuating mechanism HAM when actuated by the musician striking the piano key will strike the string 70 to allow the piano to operate in a normal acoustic piano fashion. The springs 67, 68 have, in this condition, elevated the arms 65, 66 which, in turn, elevate the silencing or muting bar 60.

The same key sensing arrangement can be applied to organs and the like keyboard instruments and the same sensor arrangements associated with the keys and keyboards can be applied to the pedals of the piano so as to detect operation of the sustain, sustenuto or soft pedals of the piano by a corresponding pedal contact board.

Referring to FIGS. 5A and 5B, a vintage electronic organ VEO has had the upper and lower keyboards 15U and 15L fitted with key actuation printed circuit sensor strips 70 (FIG. 5B) with a soft elastomeric sensor button 71 positioned under each white 72 and black 73 keys, respectively. In FIG. 5B, a portion of printed circuit board 70 has been removed to show the rigidifying bar 74 which carries the printed circuit board 70 and the sensor buttons 71. Printed circuit board 70 and the sensor buttons are purchased commercially and mounted on rigidifying bars 70. Similar key contact boards can be mounted under foot pedals 75 to sense actuation of the foot pedals by the musician.

Scanned or strobed outputs from the key contact board 70 are supplied via cable 27 (FIG. 2A) to the MIDI controller module 80 which is conventional (See AKAI MX73 MIDI Master Keyboard) and includes a liquid crystal display 81, master volume control 82 and level controls 83, control or selector switches 84 program select buttons. MIDI controller 80 is positioned on the organ with display 81 in easy view of the musician. The music stand 92 is available for use in conventional fashion. Sound module 95 (element 12 in FIG. 1) is carried on a mounting rack or frame 90 along with other components such as samplers, sequencers, etc.

The sound module unit 95 can be of a wide variety, but to enable the vintage organ VEA to sound like an expensive concert grand piano when the lower keys 15L are played, the sound module 95 can be, as noted earlier, Proformance TM Model 9101 or 9102 from E-Mu Systems, Inc.

Thus, by means of these expedients, old or vintage pianos and organs can be rejuvenated at relatively low cost so that they are in effect upgraded to the level of modern electronic musical instruments and at relatively low cost. This provides these vintage and timeworn keyboard musical instruments with the great flexibility and ease of using modern electrical and electronic components at significantly lower cost and eliminates the requirement or need to replace these old pianos and organs thereby extending their useful life indefinitely.

Some pianos and organs are in such poor condition that one or more keys stick or are damaged beyond repair. The invention contemplates rejuvenation of such pianos or organs by replacement of the entire keyboard with a new keyboard having the keyboard sensor strips mounted on the replacement keyboard.

While there has been shown and described preferred embodiments of the invention, it will be appreciated that various embodiments, adaptations and modifications of the invention will be readily apparent to those skilled in the art and can be made without departing from the spirit of the invention or the scope of the appended claims.

What is claimed is:

1. A system for rejuvenating conventional old keyboard musical instruments having keys to MIDI standards said keyboard instrument being an acoustic piano having an array of piano strings which are adapted to be struck by an array of hammers, comprising:

one or more linear arrays of key actuation sensors, printed circuit board means carrying said key actuation sensors for sensing key actuation and expression effects by a musician, means for mounting said one or more linear arrays adjacent the keyboard of said musical instrument to sense and convert each key actuation and expression effect of the musician to first coded electrical signals, respectively, control means connected to receive said first coded digital electrical signals and provide digital note control signals in MIDI format, means for simultaneously silencing all keys of said conventional keyboard musical instrument, including sound absorbing mens positionable between said arrays of hammers and piano strings, transducer means for converting actuation of foot pedals by a musician to foot pedal control signals and means connecting said foot pedal control signals to said control means, and one or more performance modules connected to receive said digital note control signals and produce a musical performance.

2. The invention defined in claim 1 wherein said means for mounting includes a rigidifying bar supporting said key actuation sensors above said keyboard.

3. The invention defined in claim 2 wherein said rigidifying bar is an aluminum channel.

4. The invention defined in claim 3 wherein said sound absorbing means is a rigid bar coated with a sound silencing medium.

5. The invention defined in claim 4 including means for positioning said rigid bar between said array of hammer and said piano strings.

6. The invention defined in claim 4 including means for producing a disable signal, and means controlled by said disable signal for positioning said rigid bar between said arrays of hammer and piano strings.

7. The invention defined in claim 6 wherein said means controlled by said disable rigid includes one or more solenoids.

8. A system for rejuvenating conventional old keyboard musical instruments having keys and foot pedals to MIDI standards, comprising:

one or more linear arrays of key actuation sensors, rigidified printed circuit board means carrying said key actuation sensors for sensing key actuation and expression effects by a musician, means for mounting said one or more linear arrays adjacent the keyboard of said musical instrument to sense and convert each key actuation and expression effect of the musician to first coded electrical signals, respectively, control means connected to receive said first coded digital electrical signals and provide digital note control signals in MIDI format, means for simultaneously silencing all keys of said conventional keyboard musical instrument, one or more performance modules connected to receive said digital note control signals and produce a musical performance, and, wherein said musical instrument is a vintage electronic organ having an operating circuit and said means for simultaneously silencing including means for disabling said operating circuit in said vintage electronic organ.

* * * * *